United States Patent [19]

Goldfarb et al.

[11] 4,206,925

[45] Jun. 10, 1980

[54] BOARD GAME WITH CHANCE OPERATION AND RANDOM STRIKER

[75] Inventors: Adolph E. Goldfarb, 4614 Monarca Dr., Tarzana, Calif. 91356; Erwin Benkoe, deceased, late of Encino, Calif., by Elisabeth Benkoe, executrix; Delmar K. Everitt, Woodland Hills, Calif.; Ronald F. Chesley, La Crescenta, Calif.; Richard D. Frierdich, Canoga Park, Calif.

[73] Assignees: Adolph E. Goldfarb; Elisabeth Benkoe, both of Northridge, Calif. ; executrix for the estate of Erwin Benkoe

[21] Appl. No.: 876,660

[22] Filed: Feb. 10, 1978

[51] Int. Cl.[2] ..... A63B 67/14

[52] U.S. Cl. ..... 273/248; 273/138 R; 46/202; 273/108

[58] Field of Search ..... 273/248, 252, 108; 124/33

[56] References Cited

U.S. PATENT DOCUMENTS

| | | | |
|---|---|---|---|
| 2,562,822 | 7/1951 | Sanger | 273/248 |
| 2,968,482 | 1/1961 | Gjertsen | 272/31 A |
| 3,481,606 | 12/1969 | Breslow et al. | 273/248 |
| 4,043,406 | 8/1977 | Wolf | 273/138 R |
| 4,079,945 | 3/1978 | Brass | 273/248 |
| 4,113,255 | 9/1978 | Goldfarb et al. | 273/108 |
| 4,125,262 | 11/1978 | Erickson | 273/101 |

FOREIGN PATENT DOCUMENTS

| | | | |
|---|---|---|---|
| 337714 | 6/1921 | Fed. Rep. of Germany | 273/108 |
| 266648 | 3/1927 | United Kingdom | 273/123 A |

*Primary Examiner*—Richard C. Pinkham
*Assistant Examiner*—Lawrence E. Anderson
*Attorney, Agent, or Firm*—Robert M. Ashen; Robert J. Schaap

[57] ABSTRACT

A surprise action game apparatus comprising in a presently preferred form a game board defining a plurality of pathways, one for each player, and each having a starting end and extending longitudinally therefrom to a finish line. There are a plurality of play pieces, one on each player's path for longitudinal movement therealong. The play pieces are adapted to be knocked over when engaged. The game apparatus further includes a knock-down unit which may be positioned at the starting end of any selected one of the pathways. The unit includes a movable wheeled toy striker vehicle and operating mechanism for propelling the vehicle along the selected pathway, but only after random or apparently random operation of the mechanism, to engage and knock down the play piece on that pathway. In play of the game, at each player's turn, the player places the knock-down unit at the start of his or her pathway and selectively operates the mechanism. For example, the player may turn a knob through increments or repeatedly push a button. Each such turn or push may permit the player to advance his or her play piece a space along the player's pathway. However, at some point after a certain number of turns or pushes, the toy striker vehicle is propelled along the player's pathway to knock over his or her play piece, which may require that the player return the play piece to the starting end. The players each attempt to be the first to advance his or her play piece to the finish line.

13 Claims, 9 Drawing Figures

BOARD GAME WITH CHANCE OPERATION AND RANDOM STRIKER

The present invention relates to a surprise action game apparatus wherein the surprise action takes place after a random or apparently random time delay or amount of activity.

In the prior art there are various toy devices using timers which after a predetermined time interval interrupt the play activity or otherwise create some action effect. For example, after a time delay a bell might ring or a figure might pop up. There have been other toy devices where the players took turns adding additional pieces to a build-up structure until the structure collapsed, or adding sticks to such a structure until the structure collapsed or pieces moved, or adding additional weight to a pointed member engaging an inflated balloon until the balloon burst.

In the illustrated play apparatus, players take turns manipulating a movable operating member in successive increments, with the player being entitled to advance his play piece along a path the same number of spaces as he manipulates the operating members. However, after a random or apparently random number of manipualtions, a wheeled toy striker vehicle will suddenly be propelled along the path and the player's play piece will be knocked over. When this happens, the player may lose a number of points, have to "go back" a number of spaces, or may lose the game.

The toy striker vehicle is directed along each player's path when it is that player's turn and the player attempts to move his play piece as many places as he can without releasing the striker vehicle. Thus in the play of the game, exciting anticipation builds until there is a sudden surprise action by the release and propulsion of the striker vehicle.

BRIEF DESCRIPTION OF THE DRAWINGS

Figure 1:
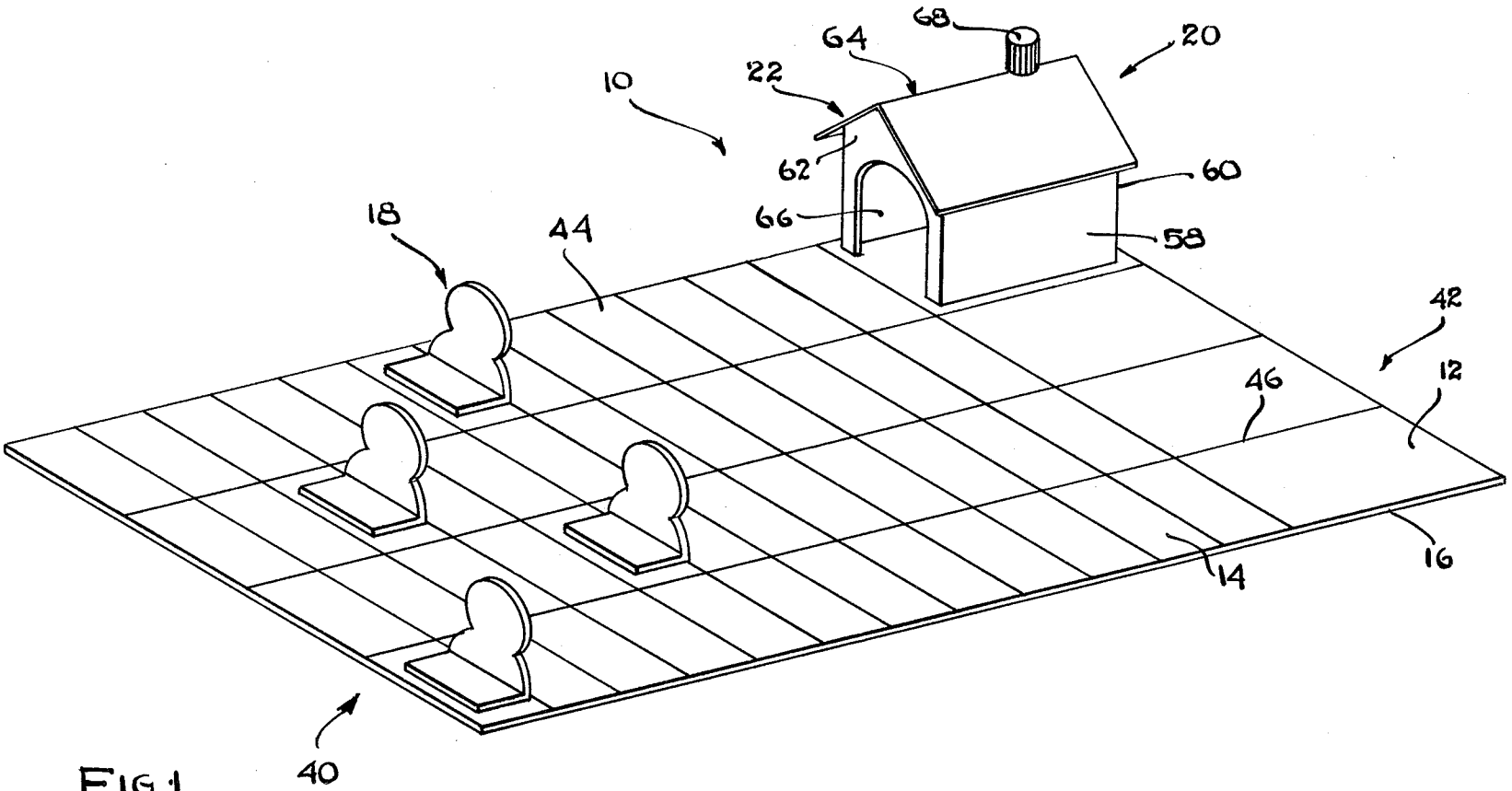
Figure 2:
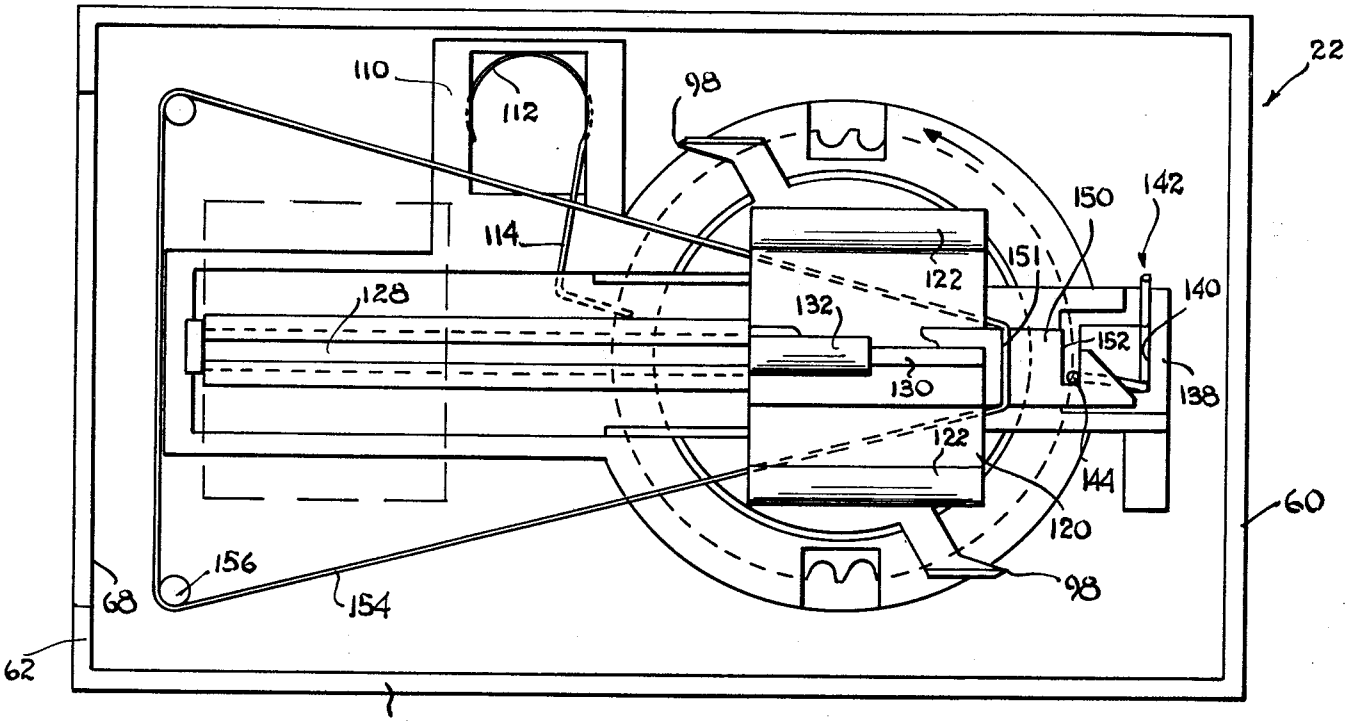
Figure 7:
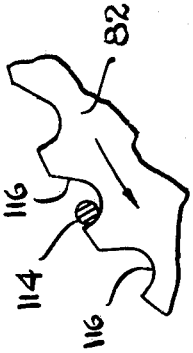
Figure 6:
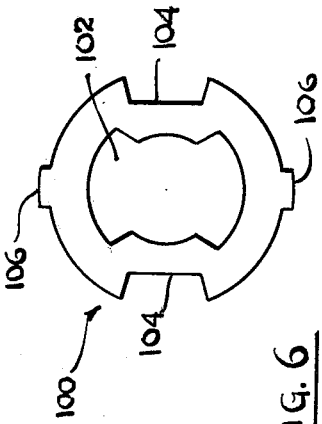
Figure 9:
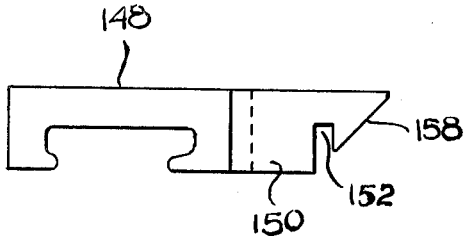
Figure 3:
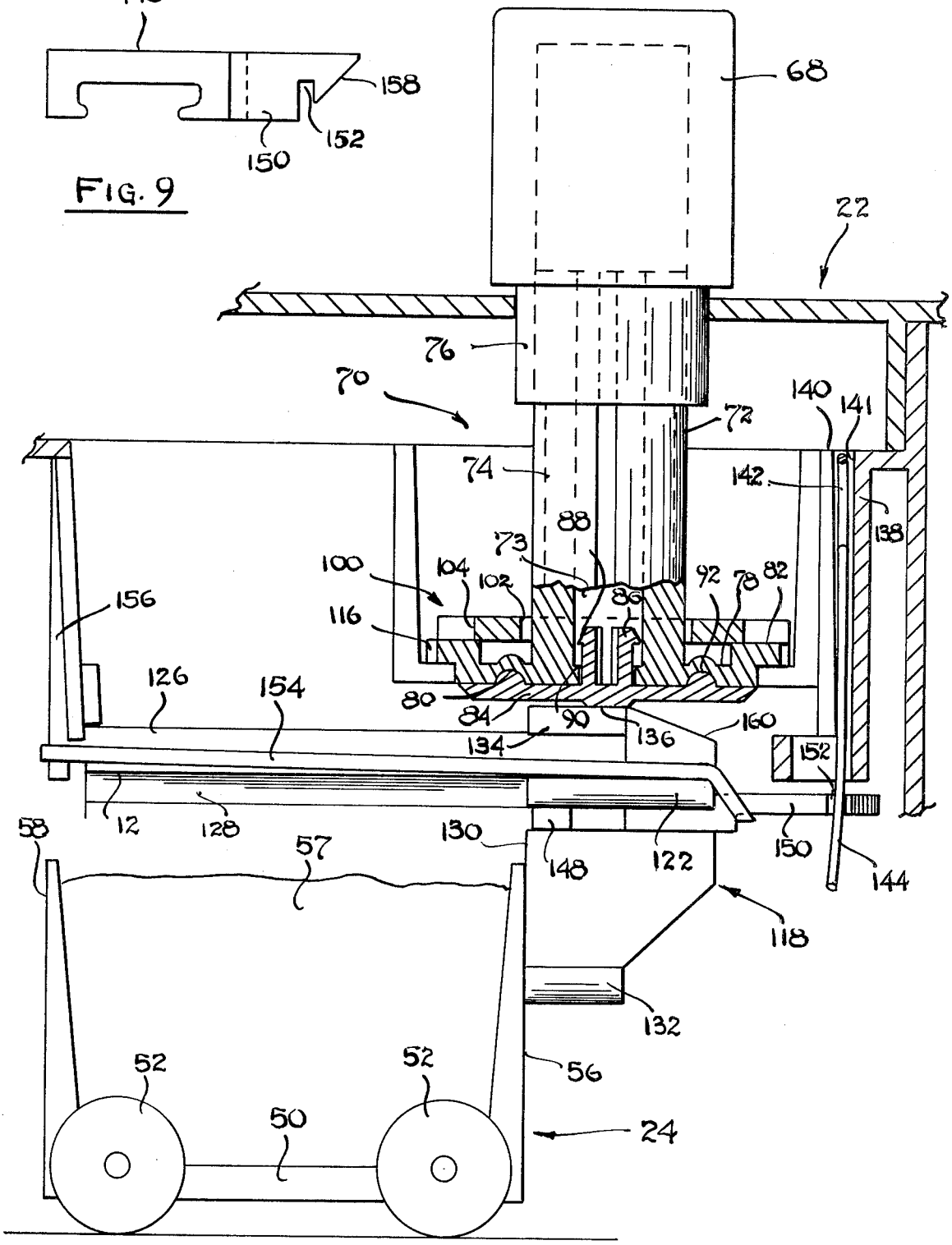
Figures 4, 5, 8:
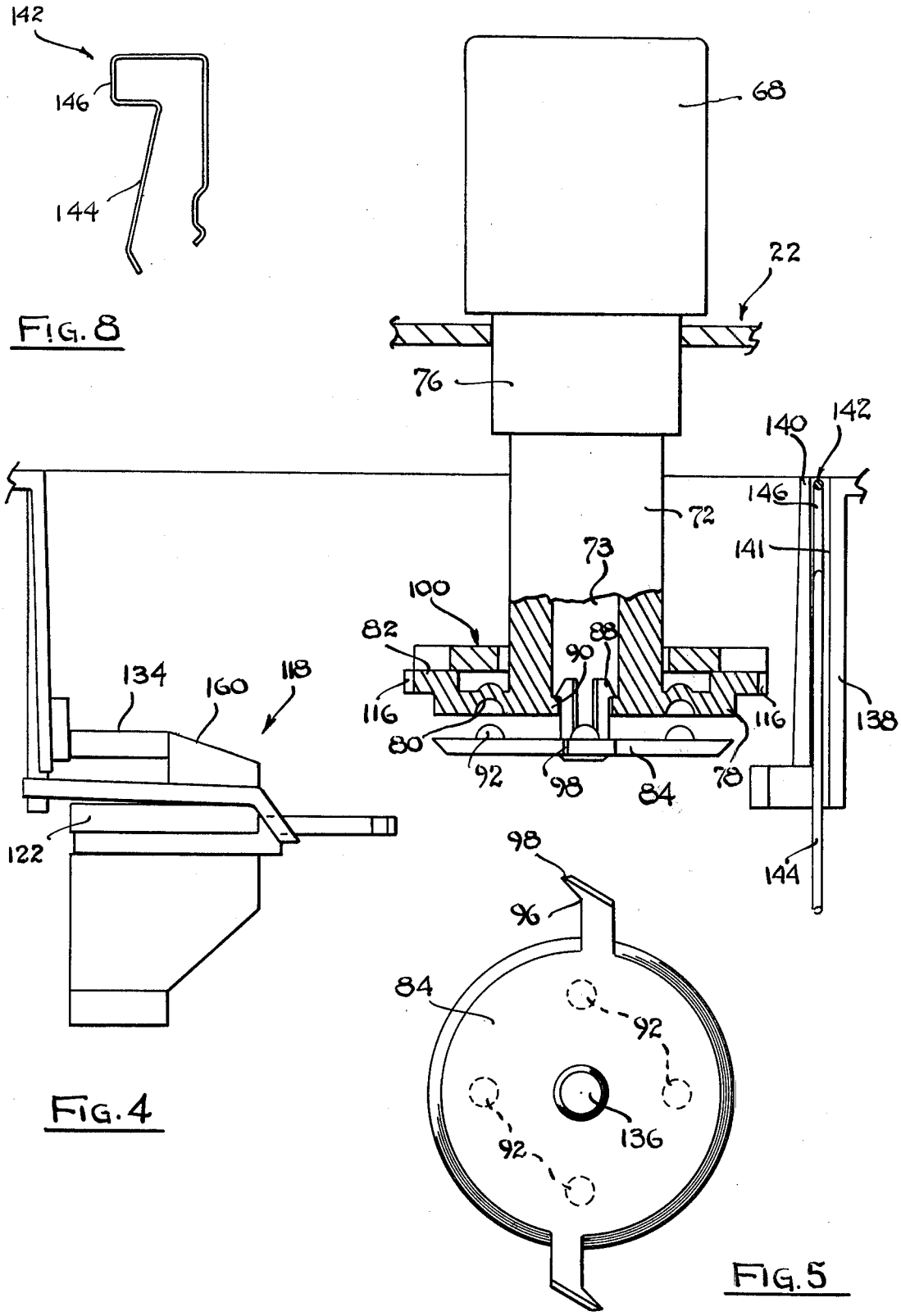

Having thus described the invention in general terms, reference will now be made to the accompanying drawings in which:

FIG. 1 is a schematic perspective view of a game playing board and components used therewith constructed in accordance with and embodying the present invention;

FIG. 2 is a bottom plan view of a randomly variable selector mchanism forming part of the present invention;

FIG. 3 is a vertical sectional view showing the components of the randomly variable selector mechanism of FIG. 2 in an assembled relationship;

FIG. 4 is a vertical sectional view, similar to FIG. 3, showing the mechanism in the disengaged position with a movable vehicle having been propelled outwardly from the mechanism housing;

FIG. 5 is a bottom plan view of a randomly variable movable selector plate forming part of the mechanism of FIG. 3;

FIG. 6 is a top plan view of a spring washer forming part of the mechanism of FIG. 3;

FIG. 7 is an enlarged fragmentary top plan view of an indexing plate forming part of the mechanism of FIG. 3;

FIG. 8 is a side elevational view of a latching spring forming part of the mechanism of FIG. 3; and FIG. 9 is a top plan view of a latch plate forming part of the mechanism of FIG. 3.

Briefly, the illustrated surprise action game apparatus 10 comprises means defining a plurality of pathways 12, one for each player. In the illustrated form, these pathways 12 are provided on the upper surface 14 of a flat game board 16 and they are disposed side-by-side and generally parallel to one another, extending from a starting end of the board longitudinally toward a finishing end or line of the board. The game apparatus 10 further includes a plurality of self-standing movable play pieces 18, one for each of the players, to be moved along one of the pathways assigned to that player. The play pieces 18 are readily tipped or knocked down when contacted or engaged.

The illustrated game apparatus further comprises a movable surprise action striker unit 20 which in the illustrated form includes a housing 22 and a wheeled toy striker vehicle 24, which is insertable into the housing for being propelled outwardly from the housing and along one of the pathways to knock down or run over the play pieces located on that pathway.

The housing 22 contains (1) power or propelling means in the form of a spring powered propelling mechanism 26, (2) latch means 28 for releasibly holding the propelling mechanism in a cocked position, (3) randomly or apparently randomly positioned release means 30 for releasing the latch means, and (4) an incrementally movable operating means 32 which is manually moved through successive increments of movement by the players until it operates the release means. Each time the latch means is released and the wheel toy striker vehicle 24 is propelled, the release means may be randomly oriented or reoriented for the next turn. Then when the wheeled striker vehicle is replaced in the housing, which cocks the propelling mechanism 26 and engages the latch means 28, the release means will be oriented in a way unknown to the players. Thus, after some unknown number of incremental movements of the operating element, the release means will release the latch means.

In the illustrated apparatus, the number of such operations of the operating member is randomly determined after every release of the striker vehicle and therefore will be different from turn to turn. Therefore, when the players begin to operate the operating member, they will not know how many times it can be operated before the striker vehicle will be released. Players can take a chance and try to operate the operating member a greater number of times so that they can move their play pieces forwardly a greater number of spaces, or they may elect to operate the operating member a lesser number of times.

Now considering the illustrated apparatus in further detail, the illustrated board 16 is generally flat and rectangular in configuration, having a starting end 40 and a finishing end 42 and a plurality of generally linear player pathways or tracks 12 extending longitudinally over its surface 14 from the beginning end to the finishing end. Each pathway 12 has designated spaces 44 therealong for advancement of the play pieces 18. Each pathway may be assigned to a player who also has one of the movable play pieces which he moves along that pathway. The board 16 may be of any suitable material such as cardboard, paper, plastic, wood, metal and the like.

Each of the player paths 12 are separated by longitudinally extending dividing lines 46. These dividing lines 46 may be substituted by upstanding walls or the like in order to define the individual player paths 12. As indicated above, each of the paths 12 are further subdivided into a plurality of longitudinally extending spaces or regions 44 such that each region 44 could correspond to a certain indicia, as for example, successive numbers. Thus, the first region of each path could have a value of 1, the second region a value of 2, the third region a value of 3, and so forth for each path 12.

In a preferred embodiment of the present invention, the play pieces 18 may adopt the form of a cat or similar animal, although it should be understood that the play pieces 18 can adopt any form of animate or otherwise inanimate object. Thus, the featured play pieces 18 could represent obstacles or the like in a manner to be hereinafter described in more detail.

The illustrated striker unit 24 is a separate unit positionable at the start of any one of the pathways and facing along the pathway so that when the striker vehicle is propelled, it will move forwardly along the pathway. Other arrangements could be utilized, as for example having the striker unit pivotally mounted so that it will face in various radially outward directions with the pathways extending radially outwardly from the striker unit so that the unit could be rotated to direct the striker vehicle along any selected one of the pathways. The pathways also might be other than straight if suitable means were provided for directing the striker vehicle along such pathway or track, as for example, a curved track having side rails which guided the movement of the striker vehicle. The striker unit could, of course, be attached to the playing board and movable relative thereto as for example, if it is pivoted as described above, or is mounted for movement on a transversely extending track to align with various pathways.

The striker vehicle 24 includes a base 50 having four rectangularly located wheels 52 mounted thereon. In addition, the vehicle 24 includes a back wall 56 and a front wall 58, the latter of which may be provided with any suitable illustration or design. In a preferred embodiment of the present invention which utilizes play pieces in the form of a cat, the vehicle 24 is provided with an object 57 representative of a dog. However, it should be understood that the vehicle 24 could adopt any form of characterization and could be an animal directly mounted on wheels, a car, a boulder on wheels, or the like. Thus, the term "vehicle" is used in a broad sense to represent any movable object.

In one mode of play, each of the plurality of players will take successive turns in rolling a dice or otherwise obtaining a score from a randomly variable device, as for example a spinner wheel, or the like. In this case, if one of the players rolls a dice with a number 3, then the player will move his or her play piece 18 into the third region 44. If the second player rolls a dice with a number 5, then that player will shift his or her play piece 18 into the fifth space. Again, the number of spaces or regions the player moves his play piece 18 will be correlated to the randomly achieved number or other indicia acquired by the player as through the roll of the dice, the spinner or the like.

The housing 22 includes an outer shell comprised of a pair of longitudinally extending sidewalls 58, a back wall 60, a front wall 62 and a top wall 64. Formed within the front wall 62 is an enlarged opening 66 which permits movement of the vehicle 24 into and out of the housing 22. Mounted on the top wall 64 of the housing 22 is a manually operable knob 68 which is capable of being incrementally rotated by each of the individual players of the apparatus. The knob 68 operates a randomly variable selector mechanism 70, which is hereinafter described in more detail. Depending upon the degrees of rotation of the knob 68 or the number of increments the knob 68 is rotated through, the randomly variable selector mechanism 70 will permit movement of the vehicle 28 out of the housing 22. Thus, if the knob 68 is turned through a sufficient number of increments in accordance with the amount necessary to trigger the release means for the release of the vehicle, as determined by the randomly variable selector mechanism 70, then the vehicle 24 will be propelled outwardly through the opening 66 in one of the player paths 12.

Thus, in accordance with the above described embodiment of the invention, if the first player moves his play piece 18 through three successive regions pursuant to a variable random number obtained through the role of a dice or other device, the player would also rotate the knob 68 through three successive increments established by three clicks. If the randomly variable selector mechanism 70 is in a position where it will release the vehicle 24 on three or less successive clicks, then the vehicle 24 will be so released and propelled down the player path 12 in order to engage and knock down the play piece 18.

The randomly variable selector mechanism 70 is more fully illustrated in FIGS. 2–9 of the drawings. The mechanism 70 comprises a generally vertically disposed tubular shaft 72 having a central bore 73 and a plurality of radially extending circumferentially spaced apart splines 74 thereon and which is fitted within a depending flange 76 formed on the lower end of the knob 68 and which extends through the top wall 64 of the housing 22. Moreover, the knob 68 is provided with a plurality of circumferentially spaced apart grooves (not shown), on its interior surface in order to receive the various splines 74. In this way, the splined shaft 72 is rotatable with the knob 68 but is axially shiftable independently of the knob 68. The knob 68 and the shaft 72 serve as a part of the incrementally movable operating mechanism 32.

At its lower end, the splined shaft 72 is rigidly secured to or otherwise integrally formed with an upper disc or wheel 78 having a plurality of closely spaced apart circumferentially extending recesses 80 on its undersurface. In the embodiment as illustrated, the plate 78 is provided with 32 circumferentially spaced recesses 80. Moreover, by reference to FIG. 2, it can be observed that the recesses 80 are very closely spaced with respect to each other. The periphery of the disc 78 is provided with an upwardly located and outwardly struck annularly extending flange portion 82.

The randomly variable selector mechanism 70 also comprises a lower disc or plate 84, which serves as the randomly or apparently randomly positioned release means 30. The plate 84 is also provided with a plurality of upwardly extending snap-in connecters 86 arranged in a circular path so as to extend within the tubular bore of the splined shaft 72. The connecters 86 are each provided with outwardly struck prongs 88 at their upper ends and which engage an inwardly formed abutment flange 90 at the lower end of the splined shaft 72. In this way, the lower plate 84 is vertically shiftable with respect to the plates 78 for a distance approximately equivalent to the vertical length of the connecters 86. Thus, the plate 84 can be disposed in engagement with the undersurface of the plate 78 and with the connecters extending upwardly into the tubular bore of the splined shaft 72. When separated, the lower plate 84 can extend downwardly until the prongs 88 engage the abutment flange 90 on the splined shaft 72.

The lower plate 84 is also provided with a plurality of upwardly located detents 92 (four as shown). The number of detents 92 should be significantly less than the number of recesses 80 formed within the bottom surface of the plate 78. In the embodiment as illustrated, one such detent 92 is provided for eight such recesses 80. Moreover, the detents 92 should be aligned properly and spaced with respect to each other so that each can fit upwardly within one of the associated recesses 80. Thus, it can be observed that the plate 84 may be independently rotatable with respect to the plate 78 and is also axially shiftable with respect to the plate 78.

As indicated previously, the plate 84 may be rotatable independently of the plate 78. The plate 84 is provided with a pair of diametrally spaced apart outwardly struck fingers 96 and each of which are provided with integrally formed and diagonally located interrupters 98, in the manner as illustrated in FIG. 5 of the drawings. These fingers 96 and the interrupters 98 function as part of the release means in a manner to be hereinafter described in more detail.

Disposed about the splined shaft 72 and located immediately above the upper disc 78 is a spring washer 100 which includes a central opening 102 somewhat larger than the splined shaft 72 so as to be independent of the rotation of the splined shaft 72. The spring washer 100 also includes a pair of diametrally opposed recesses, or so-called "cut-outs" 104. In addition, the washer 100 includes a pair of diametrally opposed tabs 106 which are located intermediate the two recesses 104. The tabs 106 are designed to extend into slots formed within the side walls of the housing 22 and thereby retain the spring-washer 100 against the upper surface of the flange 82. In this way, the spring washer 100 serves to hold the disc 78 in engagement with the disc 84 and hence holds the detents 92 within the recesses 80 on the underside of the plate 78.

A somewhat U-shaped retaining member 110 is located within the housing 22 and positioned against one of the longitudinal side walls 58 for holding a so-called "click-spring" 112 and which is provided with an outer end 114, in the manner as illustrated in FIG. 2. It can be observed that the outer end 114 of the click-spring 112 will engage a plurality of notches 116 formed on the peripheral side wall of the flange 82, forming part of the upper plate 78. Thus, as the user of the device rotates the knob 68, and hence the shaft 72, the click-spring will shift between the various notches 116 and thereby generate a click sound as it snaps into each notch. In this way, each click sound constitutes one increment of movement of the knob 68.

The notches 116 serve a second purpose in that they are provided with a shape so that they permit rotation of the plate 78 in only one direction. Thus, when the user of the device attempts to rotate the plate 78 in a counter-clockwise direction, reference being made to FIG. 2, the outer end of the click-spring 112 will engage a wall of the notch and thereby prevent such rotation. Contrariwise, when the plate 78 rotates in the opposite direction, the end of the click-spring is located so that it will ride along the periphery of the flange 82 and hence generate the clicking sound as it snaps into each notch.

Mounted within the housing 22 is a horizontally shiftable carrier 118 which forms part of the spring powered propelling mechanism 26. The carrier 118 is comprised of a horizontally disposed flat plate 120, having a pair of transversely located, longitudinally extending, somewhat cylindrically shaped bosses 122. The longitudinally extending side walls 58 of the housing 22 are provided with a pair of inwardly extending rails 124 having recesses 126 which are sized to slidably accommodate the somewhat cylindrically shaped bosses 122. In this way, the carrier 118 can shift back and forth longitudinally within the housing 22.

The rails 124 are spaced apart from each other to provide a longitudinally extending elongate slot 128 in order to accommodate a depending striker arm 130 on the underside of the horizontal plate 120. The striker arm 130 is provided at its lower end with an enlarged somewhat cylindrically shaped striker head 132 and which is positioned to engage either the base 50 or the rear wall 56 of the vehicle 24. In this way, when the carrier 118 is released, in a manner to be hereinafter described, it will be prpopelled forwardly in the housing such that the striker head 132 will engage the vehicle 124 and propel the same outwardly through the opening 66 in the front wall 62 of the housing 22.

Integrally formed with and extending upwardly from the plate 120 is an upstanding head 134 which engages the underside of a camming boss 136 which is located on the undersurface of the plate 84. In this way, it can be observed that the head 134 will hold the plate 84 into contact with the plate 78 and hence, will hold the detents 92 within the recesses 80 until the carrier 118 moves away. As this occurs, the plate 84 will be permitted to shift axially downwardly with respect to the plate 78, and hence remove the detents 92 from their interfitting engagement with the recesses 80. In like manner, when the carrier 118 is returned to its cocked position, that is when it is located under the plate 84, the head 134 will again engage the camming boss 136 and hold the plate 84 in contact with the plate 78 and hence maintain the interfitting relationship of the detents 92 in the recesses 80.

Also located within the housing 22 immediately rearwardly of the carrier 118 is an upstanding bracket 140 which is shaped to provide a retaining channel 141 for a latch spring 142, as illustrated in FIG. 3 of the drawings. In this case, it can be observed that the latch spring 142 has an inverted somewhat U-shaped construction including a pair of vertically disposed legs 144 and a laterally struck portion 146 which extends outwardly of the bracket 140.

Rigidly secured to the striker arm 130 immediately beneath the plate 120 is a latch plate 148 including a rearwardly struck tab 150 having a notch 152 formed therein. The notch 152 is sized to receive and hold the lower ends of the legs 144 of the latch spring 142. The tab 150 forms a vertically disposed shoulder 151 with the latch plate 158 to receive and engage a continuous rubber band 154, located within the housing 22. The rubber band 154 is trained about a pair of posts 156 located near the forward end of the housing and are preferably secured to the posts 156. In addition, the rubber band 154 can be engaged by the shoulder 151 at the rearward end of the latch plate 148.

When the carrier is shifted rearwardly within the housing 22, the shoulder 151 will engage the rubber band 154 and thereby stretch the rubber band until such point the carrier is locked into position. In this respect, the carrier will be locked in its position under the plate 84 when the latch spring 142 is engaged within the slot 152. For this purpose, it can be observed that the tab 150 is provided with a camming face 158 which biases the latch spring 142 into the slot 152. In addition, it can be observed that the enlarged head 134 is provided with a camming shoulder 160 at its rearward end so as to engage the underside of the camming boss 136 on the plate 184. In this way, the camming shoulder along with the enlarged head 134 will bias the plate 84 upwardly when the camming boss 136 is engaged by the enlarged head 134.

The latch spring 142 along with the tab 150 on the plate 148 and the slot 152 serve as the latch means 28, and this means will releasably hold the propelling mechanism 26 including the carrier 118. Moreover, it can be observed that when the latch means 28 is engaged with the carrier 118 the rubber band 154 will be under tension and the carrier 118 will hence be in a cocked position. Moreover, when the latch spring 142 is released from the slot 152, in a manner to be hereinafter described, the rubber band 154 will propel the carrier mechanism 118 forwardly within the housing and the striker head 132 will engage and propel the vehicle 24 outwardly of the housing as previously described.

Powered means other than a rubber band could be employed for powering the carrier 118, as for example, a spring connected to the housing and to the carrier. In addition, a wind-up motor, or similar spring wind-up mechanism could be used to engage and propel the carrier 118 upon release of the latch spring 142.

The materials used in the formation of the board 16 were described above. In addition, the various other components forming part of the apparatus of the present invention as well as the board 16 can be formed of a number of known plastic materials, as for example, polyethylene, polystyrene, polybutadiene, various vinylidene copolymers and the like, and which may be formed in a number of known plastic molding operations, as for example, thermo-forming, injection molding or the like. In addition, for purposes of increased strength and durability, many of the components could be formed of reinforced plastic materials including, for example, fiberglas, boron, carbon and other fibers and grown crystal whiskers incorporated in a suitable matrix, such as an epoxy resin or other thermo-plastic or thermo-setting resin. Notwithstanding, many of the components of the toy apparatus could be formed of other known structural materials, such as metals, etc. The various springs, e.g., the clock spring 112 and the latch spring 142 would be formed of somewhat resilient metals or at least of a thickness where they are somewhat resilient.

When a child-user operates the apparatus, he or she will rotate the knob 68 through a selected number of turns. When the carrier 118 is located beneath the plate 84, the detents 92 will be locked into four of the recesses 80 on the underside of the plate 78. Hence, the plate 78 and the plate 84 will rotate together in the clockwise direction, reference being made to FIG. 2. Depending upon the position of the arms 96 and the projections 98, they may engage the latch spring 142. Thus, if the child-user rotates the knob 68 through three increments, namely three clicks which result from the end 114 of the spring 112 engaging three successive notches 116, and the arms are still not in a position where they will engage the latch spring 142, there will be no release of the carrier 118. However, if the child user rotates the knob 68 through a sufficient degree of rotation so that the arms 96 and the projections 98 thereon engage the latch spring 142, they will deflect the spring 142 so that it moves outwardly of the slot 152. As this occurs, the carrier 118 will be released from its cocked position and will thereby be propelled forwardly in the housing to engage and propel the vehicle 24.

After the carrier 118 is propelled forwardly in the housing, the plate 84 will immediately drop from its engaged position with the plate 78. Again, the lowermost limit of travel is established by connectors 86 with the prongs 88 engaging the flange 90 on the splined shaft 72. Nevertheless, in this latter position, the plate 84 will be freely rotatable. In this way, the latch spring 142, which has been released from its latching position with the carrier, will contain some energy and spring back to engage one of the arms 96 on the plate 84. As this occurs, the spring 142 will rotate the plate 84 in a counter-clockwise direction through some related small arc. The amount of retained energy in the latch spring 142 after its release is relatively small, but nevertheless sufficient to engage the arm 96 and rotate the plate 84 through some relatively small arc. However, it can be observed that the degree of rotation of the plate 84 is quite random so that the detents 92 can be rotated to almost any position with respect to the recesses 80.

After the carrier is pulled back to its initial or cocked position, it will force the plate 84 upwardly into engagement with the plate 78 as previously described. In this way, the detents 92 will once again engage the recesses 80. It can be observed that as the carrier is pulled back into the housing, the shoulder 151 will engage the rubber band 154 so that the carrier is again in a cocked position, and in which the above-described action can again take place.

It can be observed in accordance with this embodiment of the invention that there are 32 recesses 80 on the underside of the plate 78 and four detents 92 on the upper surface of the plate 84. Hence, there is approximately one detent for every eight recesses. Thus, any one detent could be in a position where it could engage the first of each eight recesses or the seventh of each eight recesses. When engaging the first of each recess, the plate 78 and the plate 84 would have to be rotated the equivalent arcuate distance of eight notches before the arm 96 engaged the latch spring 142. In like manner, if the detents 92 engage the seventh of each eight groups of recesses 80, then the knob 68 would only have to be rotated the equivalent arcuate distance of one recess in order to cause the arm 96 to release the latch spring 142.

In accordance with the above-outlined construction, it can be observed that the randomly variable selector mechanism provides a true randomness in the action of releasing the vehicle 24. However, it should be understood that the device of the present invention could be constructed so as to operate with an apparent randomness. Thus, there could be a preselected number of random positions which are not truly random, but which appear to be random to the players. Accordingly, the term "random" or "randomly variable" will be deemed to include any mechanism which provides an apparent randomness in its action.

Thus, there has been illustrated and described a unique and novel surprise action game apparatus in which a striker member engages a play object after manipulation of a randomly variable selecter mechanism, and which therefore fulfills all of the objects and advantages sought therefor. It should be understood that many changes, modifications, variations and other uses and applications of the surprise action game apparatus will become apparent to those skilled in the art after considering this specification and the accompanying drawings. Therefore, any and all such changes, modifications, variations and other uses and applications which do not depart from the nature and spirit of the invention are deemed to be covered by the invention which is limited only by the following claims.

Having thus described our invention, what we desire to claim and secure by Letters Patent is:

1. A surprise action play apparatus comprising:
(a) base means defining at least one generally linear pathway having a starting end and extending therefrom toward a finishing end;
(b) a play target member locatable on said pathway and movable along said pathway; chance means for controlling said movement of said target member;
(c) an initially stationary striker member adapted to move along said pathway and to strike said target member, said striker member being separate from and unconnected to said base means;
(d) moving means associated with said striker member for moving said striker member along said pathway; and
(e) manually movable control means mechanically interacting with said moving means to cause automatically, after random mechanical movement or apparently random mechanical movement of said control means, said moving means to be released to suddenly move said striker member along said pathway.

2. The play apparatus of claim 1 wherein said target member is standable upright on said pathway.

3. The play apparatus of claim 1 wherein said striker member is in the form of a wheeled toy object.

4. The play apparatus of claim 3 wherein said control means comprises a progressively manually movable control element arranged to cause operation of said moving means when said element reaches a predetermined relationship with other parts of said control means.

5. The play apparatus of claim 3 wherein said moving means is a spring powered pushing mechanism, releasable by said control means.

6. The play apparatus of claim 3 wherein said wheeled toy object is self-propelled having said moving means mounted thereon, said control means being operable to release said object.

7. The play apparatus of claim 3 wherein said control means comprises a progressively manually movable control element arranged to cause operation of said moving means when said element reaches a predetermined relationship with other parts of said control means.

8. The play apparatus of claim 7 wherein said control means comprises a first indexable member which is releasably engageable with a second member, said first member being manually movable, said second member capable of being randomly rotatable when disengaged from said first member, said second member operating to release said moving means.

9. The play apparatus of claim 7 wherein said control means comprises a latch mechanism which is capable of releasing said striker member so that the means for moving said striker member propels the same.

10. A surprise action play game for a plurality of players comprising:
(a) base means defining a plurality of linear pathways, one for each player and each having a starting end and extending therefrom to a finishing end;
(b) a plurality of target members, each movable along one of said pathways, each of said target members standing upright on the associated pathway and being movable on being engaged; chance means for controlling said movement of said target members; and
(c) a play knock-down unit initially positionable in a stationary condition at the starting end of any selected one of said plurality of pathways, said unit comprising:
(i) a striker member movable along the selected pathway to engage and knock down a target member on that pathway,
(ii) means associated with said striker member for moving said striker member along said selected pathway, and
(iii) manually movable control means mechanically interacting with said moving means to cause said moving means to be released automatically, after random mechanical movement or apparently random mechanical movement of said control means, to move said striker member along said selected pathway.

11. The play apparatus of claim 10 wherein said target member is standable upright on said pathways.

12. The play apparatus of claim 10 wherein said striker member is in the form of a wheeled toy object.

13. The play apparatus of claim 12 wherein said wheeled toy object is self-propelled having said moving means mounted thereon, said control means being operable to release said object.

* * * * *